US005829204A

United States Patent [19]

Lönnberg

[11] Patent Number: 5,829,204

[45] Date of Patent: Nov. 3, 1998

[54] ARRANGEMENT FOR OPENABLE ROOF

[76] Inventor: Benth Lönnberg, Drottninggatan 188, S-252 22, Helsingborg, Sweden

[21] Appl. No.: 910,052

[22] Filed: Aug. 12, 1997

Related U.S. Application Data

[63] Continuation of Ser. No. 532,671, filed as PCT/SE94/00319 Apr. 12, 1994 published as WO94/24385 Oct. 27, 1995, abandoned.

[30] Foreign Application Priority Data

Apr. 14, 1993 [SE] Sweden ..... 9301219

[51] Int. Cl.[6] ..... E04B 1/346; E04B 7/16

[52] U.S. Cl. ..... 52/66; 52/67; 52/68

[58] Field of Search ..... 52/65, 66, 67, 52/68

[56] References Cited

U.S. PATENT DOCUMENTS 4,175,361 11/1979 Kumode ..... 52/66

FOREIGN PATENT DOCUMENTS 0 298 528 1/1989 European Pat. Off. .
298528 11/1989 European Pat. Off. ..... 52/66
2 363 686 3/1978 France .
2 545 143 11/1984 France .
2668537 4/1992 France ..... 52/66
2636686 6/1972 Germany .
239141 2/1987 Germany .
4039115 6/1992 Germany ..... 52/67

OTHER PUBLICATIONS

Derwent abstract in English for FR 2 545 143.

*Primary Examiner*—Christopher Kent
*Assistant Examiner*—Yvonne Horton-Richardson
*Attorney, Agent, or Firm*—Kane, Dalsimer, Sullivan, Kurucz, Levy, Fisele and Richard, LLP

[57] ABSTRACT

An arrangement for openable roofs, especially for glazed verandas and balconies. The arrangement is a horizontal supporting section (10) which defines an elongated guiding channel (11) having an elongated side opening (12), and a horizontal roofing panel (20) which is movable in the longitudinal direction of the supporting section (10). The roof panel (20) has a lateral edge (21) that extends into the guide channel (11) of the supporting section (10). A plurality of separate guiding and spacing members (40) are mounted spaced from each other in a direction of the guiding channel (11), on the lateral edge (21), received in the guiding channel (11), and abuts against the inner wall of the guiding channel (11) to thereby ensure that there is a play both upwards and downwards in the side opening (12) between the panel (20) and the supporting section (10). The guiding and spacing members (40) are designed so as to allow a turning movement of the panel (20). Compressible sealing means (50) are arranged in the guiding channel (11) between the side opening (12) and the guiding and spacing members (40).

9 Claims, 6 Drawing Sheets

ARRANGEMENT FOR OPENABLE ROOF

This application is a continuation of application Ser. No. 08/532,671, filed Oct. 12, 1995, now abandoned.

The present invention relates to an arrangement for openable roofs, especially openable roofs for glazed verandas and balconies, comprising a substantially horizontal supporting section which forms an elongate guiding channel having an elongate side opening, and a roofing panel whose one lateral edge extends into the guiding channel of the supporting section through the side opening thereof and which is movable relative to the supporting section in the longitudinal direction thereof.

By the expression "a substantially horizontal supporting section" is meant a section which is either horizontal or slightly inclined relative to the horizontal plane in dependence of the desired inclination of the roof.

An arrangement of the above-mentioned type must be designed while taking several factors into consideration. First, the arrangement must be designed in view of the fact that during mounting it may be difficult to attach the supporting sections, between which the roofing panels are movably mounted, in exactly correct positions relative to each other. Second, it must be taken into consideration that after completion of the mounting, some parts of the arrangement may move little by little. Third, the arrangement must withstand any downward bending of the panel when subjected to wind and snow loads. Fourth, the arrangement must be completely tight under any circumstances whatsoever. Fifth, the panel should always be easy to move; in particular, the movability of the panel must not be jeopardised by dirt or water penetrating into the guiding channel or owing to the panel being inclined. Sixth, the arrangement, especially the panel and any guiding elements, should have a long life and withstand a great number of opening and closing movements of the panel. Finally, the arrangement must be easy to mount and the manufacturing cost must be reasonable.

Today, there are no arrangements for openable roofs of the type mentioned by way of introduction which satisfy all of the above-mentioned criteria.

Examples of two prior-art arrangements of the type mentioned above are disclosed in GB-A-2,169,326 and EP-A1-0,239,141.

GB-A-2,169,326 discloses a structure especially designed to cope with problems caused by different heat expansion coefficients of the panel and the supporting structure. To this end, the panel of this prior-art arrangement may move also laterally relative to the guiding section, i.e. transversely of its direction of displacement. The height of the side opening of the guiding channel is smaller than the internal height of the guiding channel, and the lateral edge of the panel is, at least on one face, provided with an elongate ridge which prevents the panel from falling out and which extends continuously along the lateral edge of the entire panel. The document also discloses embodiments in which the panel is provided with two such ridges preventing the panel from falling out and disposed opposite one another each on one face of the panel. The ridge or ridges is/are arranged with a play towards the inner wall of the channel, but are so high that they cannot be moved out through the side opening of the section, thereby preventing the lateral edge of the panel from falling out from the guiding channel. According to GB-A-2,169,326, the panel rests and slides with its lower side, at a distance from its lateral edge received in the guiding channel, directly against an elongate, upwardly directed supporting edge of the section, which defines the lower border of the side opening.

EP-A1-0,239,141 discloses an arrangement having both a fixed and a displaceable panel. The displaceable panel rests, like the panel according to GB-A-2,169,326, with its lower side on an elongate, upwardly directed edge of the section, in this case via a friction-reducing plastic strip. Furthermore, the lateral edge of the panel extends, in the same manner as in the GB publication, past this supporting edge of the section and sideways into the guiding channel of the section. Inside the guiding channel, there is a play both upwards and downwards between the lateral edge of the panel and the inner wall of the guiding channel. Therefore, a certain vertical turnability should also be possible in this prior-art arrangement. An elongate brush-type strip is mounted in a groove in the upper wall of the guiding channel and extends downwards into sliding engagement with the upper side of the panel.

One more example of roofing panels having a certain turnability about their supporting line is disclosed in U.S. Pat. No. 3,550,335 which concerns, however, stationary panels. Like in the above-mentioned two documents, the panels rest with their lower faces, spaced from their lateral edges, directly on upwardly directed supporting edges in the plane coinciding with the side opening of the guiding channel.

However, none of the above-mentioned prior-art arrangements satisfies all these requirements.

According to the present invention, an arrangement for openable roofs having the features defined in the accompanying claims is provided in order to satisfy the requirements mentioned above.

The most distinguishing feature of the invention is that the panel can be inclined to a certain extent transversely of its moving direction in the guiding channel, while maintaining satisfactory sealing and movability. This feature is not to be found in any of the prior-art arrangements. Moreover, there does not, according to the present invention, arise any wear of the panel caused by the movement thereof since the side of the panel does not abut directly against the supporting section, but rests on mutually separate guiding and spacing members.

For better understanding of the inventive idea, an exemplifying, non-restrictive embodiment of the invention will now be described below with reference to the accompanying drawings.

Figure 1:
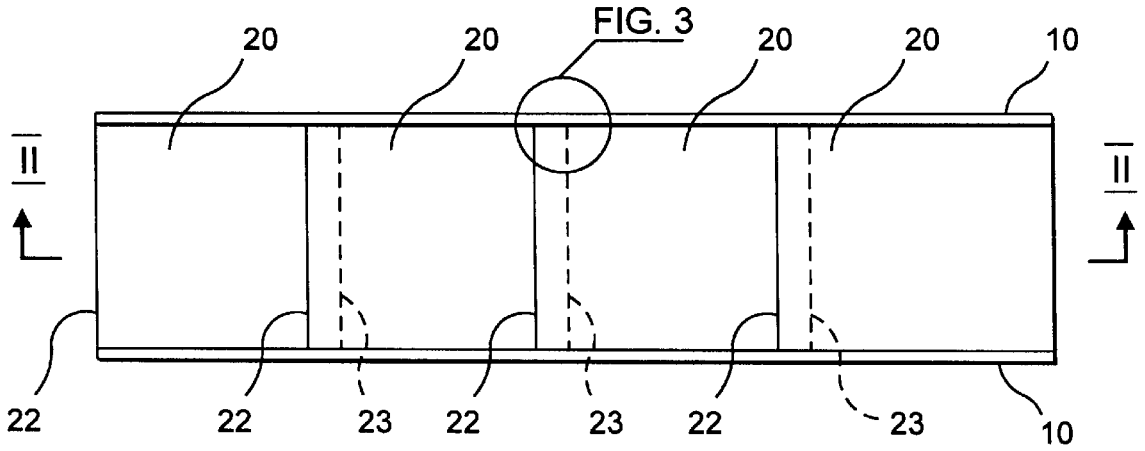
FIG. 1 is a schematic top plan view of an openable roof to which the present invention is applied.

It will be appreciated that the arrangement illustrated in the accompanying drawings is shown schematically only and that the dimensional relationship between different elements may, in practice, deviate to a substantial degree from that shown in the drawings.

The roof arrangement shown in the drawings comprises two horizontal, mutually parallel supporting sections 10, and four essentially identical roofing panels 20 which at their opposite lateral edges 21 are movably received in the supporting sections 10. The supporting sections 10 are preferably extruded aluminium sections. The roofing panels 20 can be made of glass sheets, transparent plastic sheeting or some other sheeting.

Figure 5:
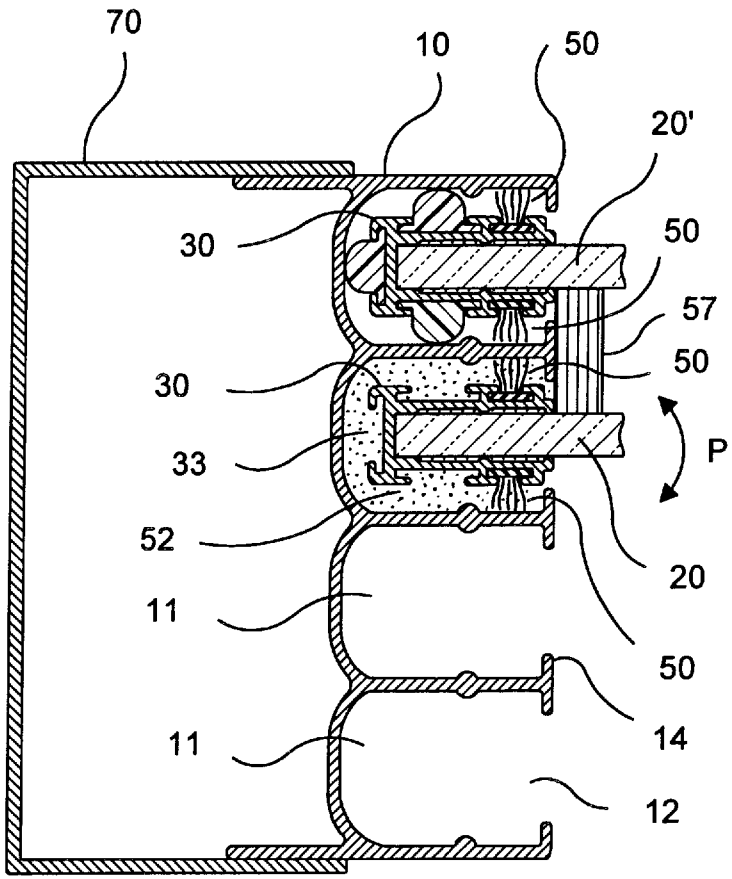
FIG. 5 is a cross-sectional view along line V—V in FIG. 3, some structural elements being removed for the sake of clarity.
Figure 4:
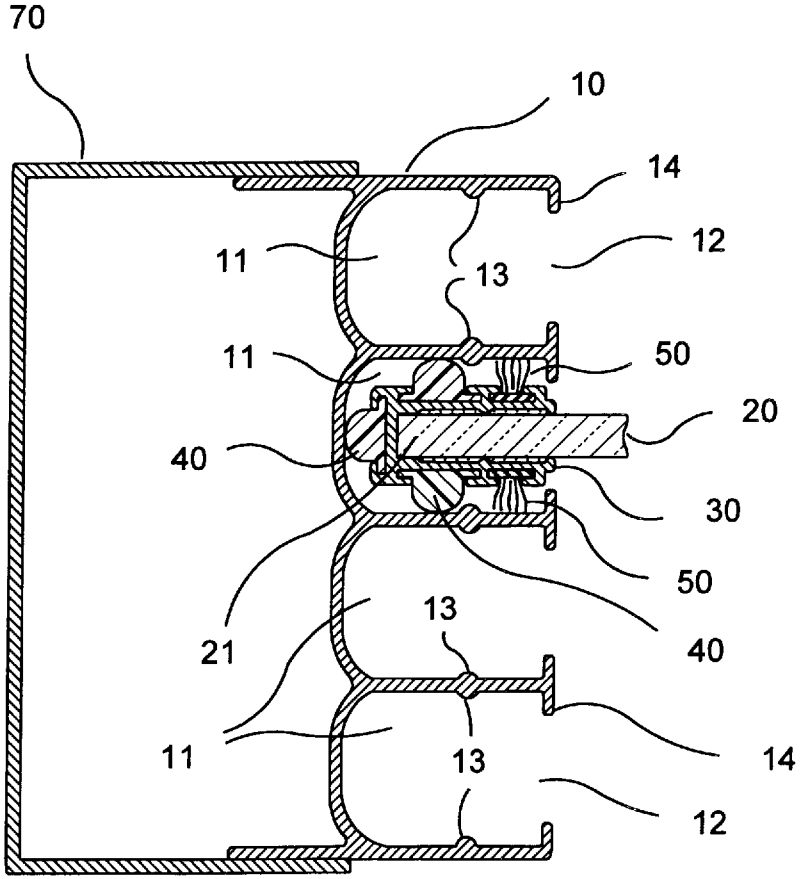
FIG. 4 is a cross-sectional view along line IV—IV in FIG. 3, some structural elements being removed for the sake of clarity.
Figure 7:
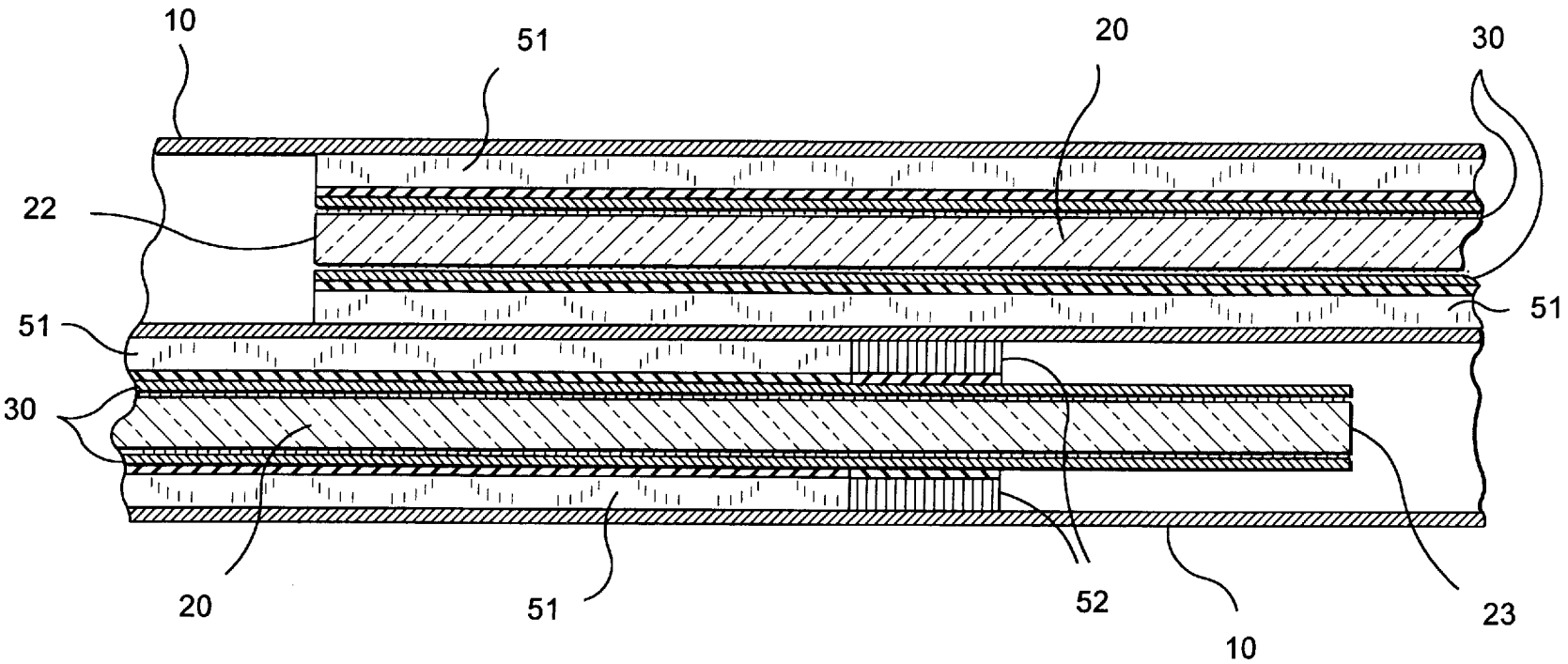
FIG. 7 is a sectional side view along line VII—VII in FIG. 3.

As is best shown in the cross-sectional views in FIGS. 4 and 5, each supporting section 10 comprises four elongate, U-shaped guiding channels 11 for receiving one roofing panel 20 each. The roofing panels 20 are movable in the longitudinal direction of the supporting sections 10 between the closed position shown in FIG. 2, in which the panels 20 partly overlap each other, and open positions in which the panels 20 are more or less moved together one on top of the other. The number of panels 20 and guiding channels 11 may, of course, vary. Moreover, it is also conceivable that one or more of the panels 20 are fixedly mounted.

The arrangement according to the invention generally relates to the supporting of the panels 20 and the possibilities of moving them in the guiding channels 11, and seals in connection therewith, and since this arrangement in the illustrated embodiment is identical for all panels 20, only one such arrangement will be described below.

FIGS. 4 and 5, to which reference is now especially made, illustrate how the lateral edge 21 of the panel 20 extends through a side opening 12 in the guiding channel 11 of the supporting section 10. For the purpose of reinforcement, the lateral edge 21 of the panel 20 is received in a load-distributing edge section 30 which is in the form of a lying U and which may comprise an extruded aluminium section. The edge section can be attached in some suitable manner to the panel lateral edge 21, for example by gluing, and this joint must be watertight. In the illustrated embodiment, the edge section 30 is essentially completely received inside the guiding channel 11, but can, in other embodiments, extend outside the guiding channel.

The edge section 30 is formed with five longitudinal, mutually parallel mounting grooves (see also FIG. 3), viz. an upper and a lower outer groove 31, an upper and a lower inner groove 32, and an edge groove 33.

Figure 3:
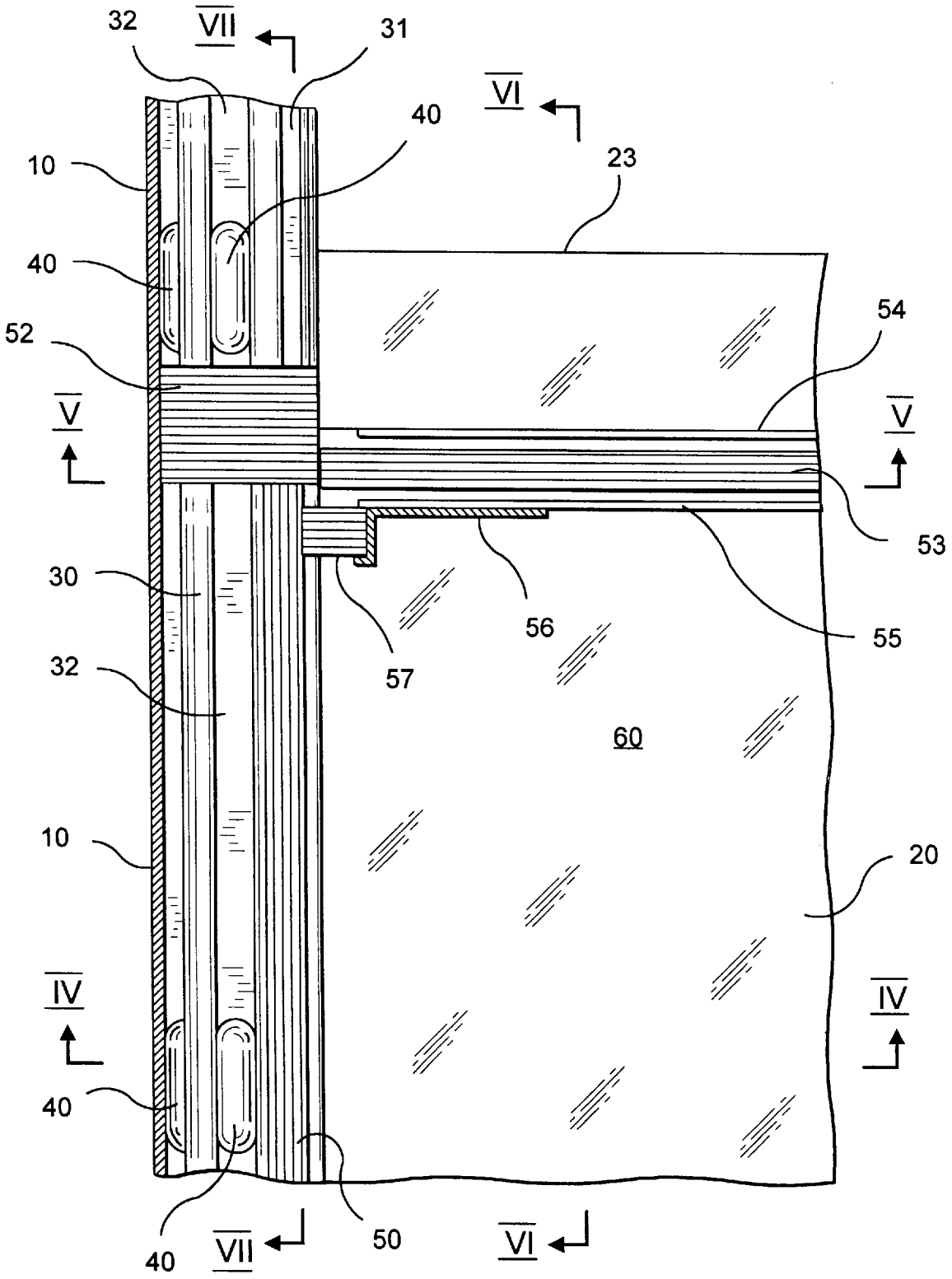
FIG. 3 is an enlarged top plan view of a portion marked with a circle in FIG. 1.
Figure 8:
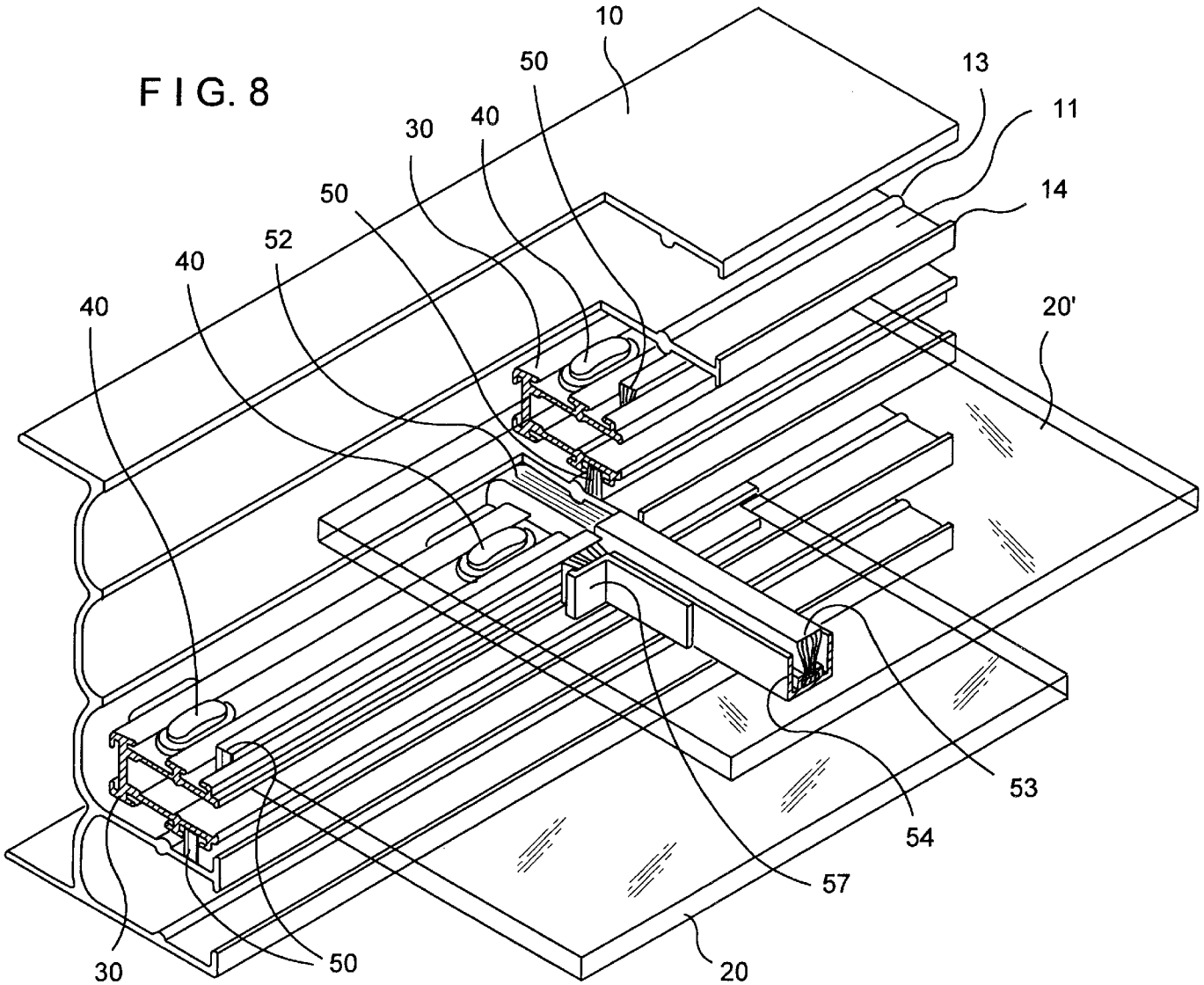
FIG. 8 is a perspective view of the inventive arrangement in FIGS. 1–7, some parts being broken away.

In the upper and the lower inner groove 32 of the edge section 30, a plurality of separate guiding and spacing members 40 are mounted, spaced from each other in the direction of the guiding channel 11 as illustrated in FIGS. 3 and 8. The corresponding guiding and spacing members 40 are also mounted in the edge groove 33. The design of the grooves 32 and 33 and the spacing members 40 is such that, during mounting, the spacing members can be pushed into the grooves at the end of the edge section 30 to the correct position and then be fixed in some suitable manner, for example by local deformation of the edge section 30.

In the illustrated embodiment, the guiding and spacing members 40 are designed as rod-like, massive sliding blocks made of a synthetic material having low friction against the inner wall of the guiding channel 11. The sliding blocks 40 have a convex exterior facing the inner wall of the guiding channel 11 for reasons that will be explained below.

The panel 20 rests via the edge section 30 and the lower sliding blocks 40 on such a level in the guiding channel 11 that there is a play in the plane of the side opening 12 both upwards and downwards between the supporting section 10 and the panel 20.

The upper sliding blocks 40 prevent the panel 10 from rising in the guiding channel, e.g. when subjected to wind loads.

Since the panel 20 runs with a play both upwards and downwards in the side opening 12 of the guiding channel 11 and since the supporting points of the panel 20 are disposed inside the guiding channel 11, the panel 20 has the possibility of assuming a slightly inclined position, as indicated by a double arrow P in FIG. 5, while maintaining the supporting and moving function of the arrangement. Such an inclination may arise if, for example, the supporting sections 10 are not mounted exactly in parallel and in alignment with each other, or if the panel 20 is bent downwards owing to wind and snow loads.

As shown in FIGS. 4 and 5, the walls of the supporting section 10 which form the top and bottom of the guiding channel 11 are formed with longitudinal ridges 13 which are spaced in horizontal direction from the side opening 12. The ridges 13, which extend continuously over the entire length of the supporting section 10, function, together with the sliding blocks 40, as guiding members, especially during mounting when the lateral edge 21 of the panel 20 with the edge section 30 mounted and the sliding blocks 40 should be moved into the guiding channel 11 from the end of the supporting section 10. The ridges 13 also cooperate with the sliding blocks 40, thereby preventing the panels from falling out. The position of the ridges 13 in horizontal direction is, however, such that the above-mentioned turnability of the panel 20 in the direction of arrow P is not jeopardised. If, for example, the lateral edge 21 in FIG. 5 is turned slightly clockwise, the lower sliding blocks 40 should be able to slide to the left in the guiding channel away from the lower ridge 13, while the upper sliding blocks 40 will abut, to the right, against the upper ridge 13.

As is best shown in FIGS. 3, 4 and 5, longitudinal brush-type strips 50 of a type known per se are mounted in the upper and the lower outer groove 31 of the edge section 30. The brush-type strips 50 are disposed completely inside the guiding channel 11 between the side opening 12 and the sliding blocks 40 received in the grooves 32, and sealingly abut against the upper and the lower side wall of the guiding channel 11. The brush-type strips 50 prevent water and dirt from penetrating sideways into the guiding channel 11. By the brush-type strips 15 being compressible, the above-mentioned, desired turnability of the panel 20 in the direction of arrow P is not jeopardised.

Figure 2:
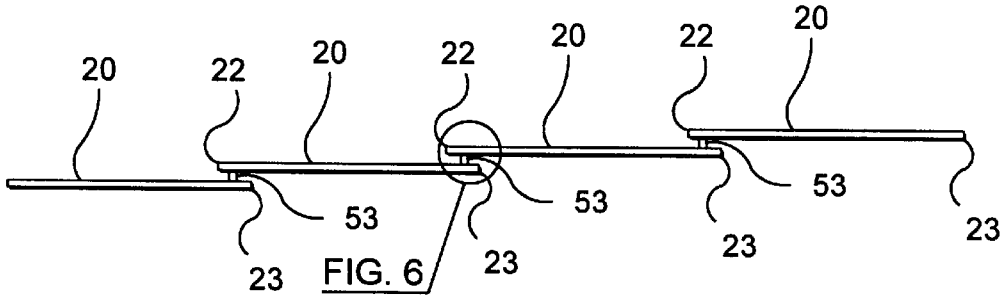
FIG. 2 is a sectional side view taken along line II—II in FIG. 1.

The brush-type strips 50 extend from the outer terminal edge 22 (FIGS. 1 and 2) of the panel 20 up to a transverse seal 52 (FIG. 3) which is spaced from the inner terminal edge 23 of the panel 20 (FIGS. 1 and 2). This transverse seal 52 consists of a slightly wider brush-type seal which is fixedly mounted on the edge section 30 and whose bristles sealingly engage the entire inner wall of the guiding channel 11, as shown in the uppermost but one guiding channel 11 in FIG. 5. The transverse seal 52 serves to prevent water in the guiding channel 11 from flowing from below and upwards in FIG. 3, i.e. to prevent water, if any, in the guiding channel 11 from flowing up to the inner terminal edge 23 of the panel 20 and down under the roof. The transverse seal 52 also helps effectively to keep the inner wall of the guiding channel 11 clean from dirt, thereby maintaining satisfactory slidability between the sliding blocks 40 and the inner wall of the guiding channel 11. The upwardly extending end flanges 14 of the bottom walls of the guiding channels 11 prevent any leaking water in the guiding channel 11 from flowing into the space under the roof. These end flanges 14 may thus cause some damming up in the guiding channel 11 so as to force such leaking water to flow in the direction of the sloping roof in the supporting section 10.

Figure 6:
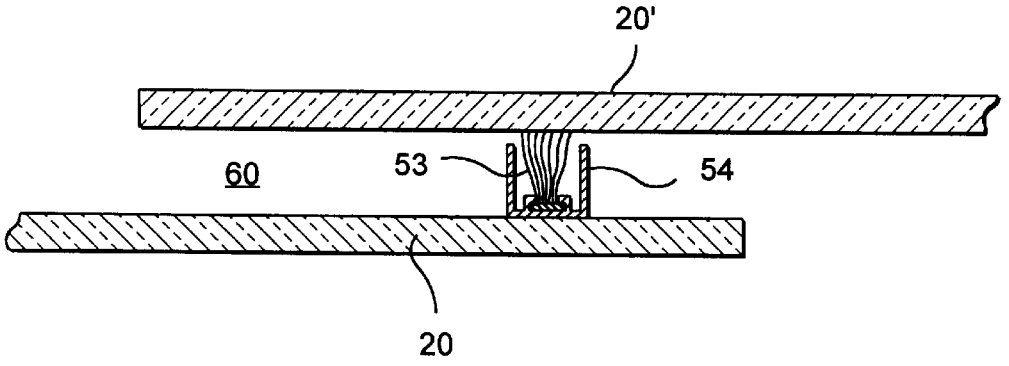
FIG. 6 is a sectional-side view along line VI—VI in FIG. 3.

A seal between a panel 20 and a superjacent panel 20' (FIGS. 3 and 6) is established by means of a transverse, upwardly directed brush-type strip 53. In the embodiment illustrated, such transverse brush-type strips 53 are to be found merely on the three left-hand panels 20 in FIGS. 1 and 2. The brush-type strip 53 is mounted in an upwardly open U-section 54 whose base is sealingly connected to the upper side of the panel 20 approximately on the same level as the transverse seal 52 (FIG. 3).

On the side 55 of the U-section 54 facing the outer terminal edge 22 of the panel 20, a vertical brush-type strip 57 (FIG. 3) is mounted on a holder 56 and slidingly seals against the side of the supporting section 10. A corresponding vertical brush-type strip 57 is understood to be arranged also at the other end of the U-section 54 in FIG. 3.

By means of the sealing arrangement described above and shown in the drawings, a satisfactory circumferential seal is established in the space 60 open towards the outside of the roof (FIGS. 6 and 3) between two neighbouring panels 20, 20'. In case of rain and wind, there will be an "air pocket" at the very back of this space adjacent the transverse seal 53 and the longitudinal brush-type seal 50. In other words, water will normally not be blown all the way to the transverse seal 53.

Condensation water, if any, from a superjacent panel 20' is collected in the U-section 54 and is conducted, after some damming up, via drain holes (not shown) out on the subjacent panel 20.

The component 70 shown in FIGS. 4 and 5 is a U-shaped mounting section whose inner dimensions essentially correspond with the outer dimensions of the supporting section 10. When mounting the roof, first the mounting section 70 is fixed, which may possibly consist of a number of separate parts instead of a continuous section. Subsequently, the supporting section 10 can be mounted in the mounting section 70 and adjusted in lateral direction before or after mounting of the panels 20, whereupon the supporting section 10 is fixed in some suitable manner.

It will be appreciated that the invention is not restricted to the embodiment described above, and that several modifications can be made without deviating from the scope of the invention as defined in the accompanying claims.

Figure 9:
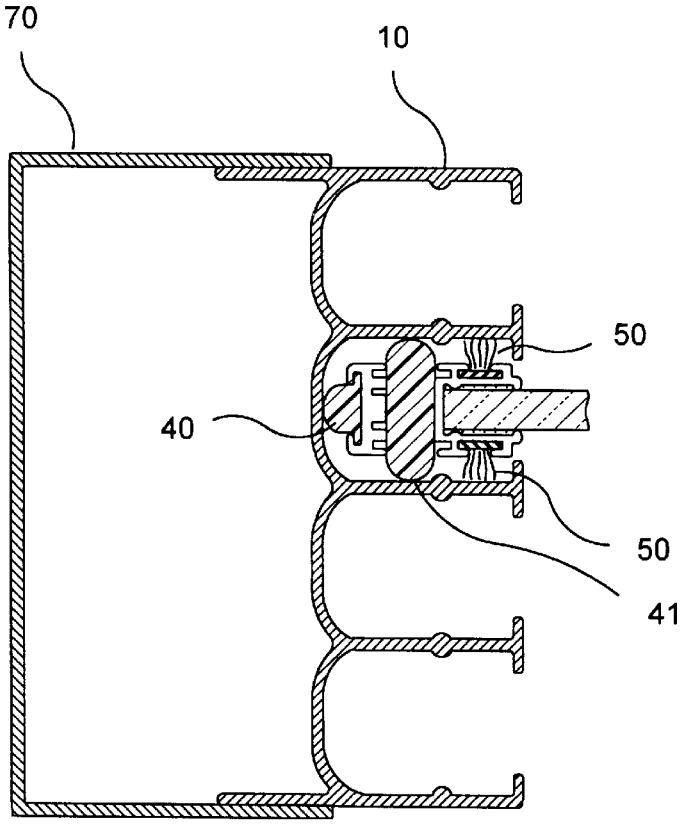
FIG. 9 is a cross-sectional view corresponding to FIG. 4, but illustrates an alternative embodiment of the guiding and spacing members.
Figure 10:
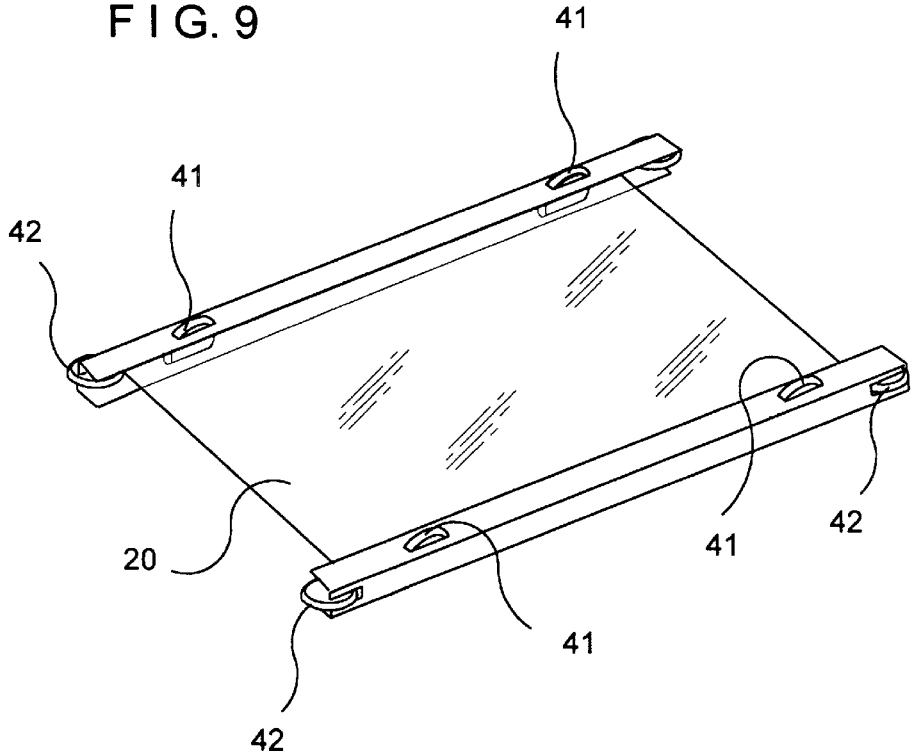
FIG. 10 is a schematic perspective view of a roofing panel according to an alternative embodiment of the invention.

For example, the guiding and spacing members 40 can be designed in some other manner than as massive sliding blocks, e.g. as separate wheels or rollers rotatably mounted in the edge section 30, as illustrated in the cross-sectional view in FIG. 9. In this Figure, the sliding blocks 40 received in the grooves 32 are replaced with wheels 41 which are received in the respective openings in the edge section 30 and each rotatably mounted on its horizontal axle. It is understood that there is a limited play between the wheels 41 and the top wall of the guiding channel 11 so as to permit rolling. A corresponding gap may also be found upwards and sideways in the embodiment which comprises sliding blocks. Such wheels or rollers 41 should have, as shown in FIG. 9, a convex abutment surface against the inner wall of the guiding channel 11 in the same manner as the sliding blocks 40 in the embodiment shown so as to facilitate the above-mentioned turnability of the panel 20. Correspondingly, the horizontally extending sliding blocks 40 in the edge groove 33 can be replaced with separate horizontal wheels or rollers. FIG. 10 schematically illustrates a roofing panel 20 with such horizontal wheels 42 at the ends of the supporting sections 10 and with vertical wheels 41 according to FIG. 9 over the length of the supporting sections 10.

The sliding blocks 40 in the edge groove 33 can possibly be excluded, but provide advantageous guiding when the lateral edges 21 of the panels 20 are to be moved into the supporting section 10 during mounting.

I claim:

1. An openable roof, especially for glazed verandas and balconies, comprising:

two parallel, mutually spaced supporting sections, which define a plurality of elongated, parallel guiding channels for receiving roofing panels in a plurality of adjacent levels within the mutually spaced supporting sections;

a plurality of roofing panels, each of which presents two opposite lateral panel edges received in and movable within said guiding channels, wherein, when the roof is closed, panels in adjacent levels overlap each other and define overlapping spaces between said panels;

longitudinal sealing means which are supported by and extend along said lateral panel edges; and transverse sealing means which are arranged in a space between panels and extend between sa two supporting sections;

whereby said longitudinal sealing means and said transverse sealing means in combination form U-shaped circumferential seals around said overlapping spaces, such that a first air pocket is created in the overlapping spaces between adjacent panels.

2. An openable roof as claimed in claim 1, wherein said longitudinal sealing means are located within said guiding channels.

3. An openable roof as claimed in claim 1, wherein said longitudinal sealing means comprise elongate brush-type strips.

4. An openable roof as claimed in claim 1, wherein said transverse sealing means comprises, for each pair of two adjacent panels, a longitudinal seal member mounted on a lower one of said adjacent panels.

5. An openable roof as claimed in claim 1, wherein said longitudinal seal member comprises an elongate brush-type strip.

6. An openable roof as claimed in claim 1, wherein the guiding channels and the associated lateral panel edges received therein together define, within the guiding channels, elongate channel spaces having U-shaped cross sections; and wherein said lateral panel edges are provided with channel sealing means, extending in U-shaped around the associated lateral panel edges within said channel spaces, such that said channel sealing means and said longitudinal sealing means in combination form elongated second air pockets within said guiding channels, said second air pockets extending on each side of said first air pockets.

7. An openable roof as claimed in claim 6, wherein said channel sealing means comprise brush-type sealing members.

8. An openable roof as claimed in claim 6, wherein said channel sealing means form lateral extensions of said transverse sealing means within said guiding channels.

9. An openable roof as claimed in claim 1 wherein two walls of said supporting sections form a top wall and a bottom wall, respectively, of the guiding channels, each of which are formed with longitudinal ridges, said ridges being intended to cooperate with guiding and spacing members of the roofing panels to prevent the panels from falling out.

* * * * *